US008201564B2

(12) United States Patent
McHugh et al.

(10) Patent No.: US 8,201,564 B2
(45) Date of Patent: Jun. 19, 2012

(54) CIGARETTE FILTERS

(75) Inventors: Mark A. McHugh, Richmond, VA (US); Georgios Karles, Richmond, VA (US); Diane Gee, Richmond, VA (US); Joseph L. Banyasz, Richmond, VA (US); Zhihao Shen, Richmond, VA (US); Munmaya K. Mishra, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 1345 days.

(21) Appl. No.: 11/607,949

(22) Filed: Dec. 4, 2006

(65) Prior Publication Data

US 2008/0029112 A1 Feb. 7, 2008

Related U.S. Application Data

(60) Provisional application No. 60/754,642, filed on Dec. 30, 2005.

(51) Int. Cl.
*A24D 3/06* (2006.01)

(52) U.S. Cl. ..... 131/280; 131/215.2; 131/335; 131/339; 493/39; 493/44; 493/50; 427/248.1

(58) Field of Classification Search ..... 131/280; 493/39
See application file for complete search history.

(56) References Cited

U.S. PATENT DOCUMENTS

| | | | | |
|---|---|---|---|---|
| 4,259,969 | A | | 4/1981 | Houminer et al. |
| 4,281,671 | A | | 8/1981 | Bynre et al. |
| 4,598,006 | A | | 7/1986 | Sand |
| 4,678,684 | A | | 7/1987 | Sand |
| 4,729,391 | A | * | 3/1988 | Woods et al. ..... 131/332 |
| 4,820,752 | A | | 4/1989 | Berens et al. |
| 4,862,905 | A | | 9/1989 | Green, Jr. et al. |
| 5,356,704 | A | | 10/1994 | Phillips et al. |
| 5,508,060 | A | | 4/1996 | Perman et al. |
| 5,607,766 | A | * | 3/1997 | Berger ..... 428/373 |
| 5,692,525 | A | | 12/1997 | Counts et al. |

(Continued)

FOREIGN PATENT DOCUMENTS

DE 4202320 A1 8/1993

(Continued)

OTHER PUBLICATIONS

International Search Report and Written Opinion dated Jan. 7, 2008 for PCT/IB2006/004218.

(Continued)

*Primary Examiner* — Philip Tucker
*Assistant Examiner* — Vicki Wu
(74) *Attorney, Agent, or Firm* — Buchanan Ingersoll & Rooney PC

(57) ABSTRACT

Fibrous material suitable for incorporation into filter elements of smoking articles such as cigarettes are impregnated with additives and agents such as flavorants, flavorant-enhancers and/or free radical scavengers. The fibrous material is contacted with the additive dispersed in a high pressure gas or supercritical fluid (SCF) held at elevated pressures. The high pressure gas or SCF swells the fibrous matrix and enables the additive to be incorporated within the matrix. When pressure is reduced, the gas or SCF vaporizes and leaves the additive embedded in the fiber interstices. As a result, the additive is slowly released over a finite period of time. When incorporated into a cigarette filter, the additive is released at a desired rate from the interior of the fibrous filter into the cigarette smoke.

2 Claims, 3 Drawing Sheets

U.S. PATENT DOCUMENTS

| | | | | |
|---|---|---|---|---|
| 5,975,086 | A | 11/1999 | Lesser et al. | |
| 6,030,462 | A | 2/2000 | Shu et al. | |
| 6,053,176 | A | 4/2000 | Adams et al. | |
| 6,200,637 | B1 | 3/2001 | McClain et al. | |
| 6,270,844 | B2 | 8/2001 | McClain et al. | |
| 6,495,204 | B1 | 12/2002 | Allen et al. | |
| 6,584,979 | B2 | 7/2003 | Xue et al. | |
| 6,591,841 | B1 | 7/2003 | White et al. | |
| 6,772,768 | B2 | 8/2004 | Xue et al. | |
| 6,792,953 | B2 | 9/2004 | Lesser et al. | |
| 2002/0020420 | A1 * | 2/2002 | Xue et al. | 131/203 |
| 2002/0062833 | A1 * | 5/2002 | Xue et al. | 131/331 |
| 2002/0166563 | A1 | 11/2002 | Jupe et al. | |
| 2003/0159703 | A1 * | 8/2003 | Yang et al. | 131/335 |
| 2004/0016436 | A1 | 1/2004 | Thomas | |
| 2004/0058085 | A1 | 3/2004 | Propp et al. | |

FOREIGN PATENT DOCUMENTS

| | | | | |
|---|---|---|---|---|
| GB | 266602 | A | | 3/1927 |
| GB | 2190275 | A | | 11/1987 |
| KR | 2005004666 | A | * | 1/2005 |
| WO | WO93/14259 | A | | 7/1993 |
| WO | WO94/18264 | A | | 8/1994 |

OTHER PUBLICATIONS

Stern and De Meringo, "Solubility of Carbon Dioxide in Cellulose Acetate at Elevated Pressures," *J. Polm. Sci.: Polym. Phys. Ed*. 1978, 16, 735, John Wiley & Sons, Inc.

Chow, "Molecular Interpretation of the Glass Transition Temperature of Polymer-Diluent Systems," *Macromolecules*, 1980, 13, 362, American Chemical Society.

Sada et al., "Permeation of Carbon Dioxide Through Homogeneous Dense and Asymmetric Cellulose Acetate Membranes," *J. Polym. Sci.: Part B: Polym. Phys*., 1996, 62, 2181, John Wiley & Sons, Inc.

Hachisuka et al., "Glass Transition Temperature of Glassy Polymers Plasticized by $CO_2$ Gas," *Polym. J*., 1990, 22, 79, Elsevier.

Houde et al., "Permeability of Dense (Homogeneous) Cellulose Acetate Membranes to Methane, Carbon Dioxide, and Their Mixtures at Elevated Pressures," *J. Appl. Polym. Sci*., 1996, 62, 2181, John Wiley & Sons, Inc.

* cited by examiner

CIGARETTE FILTERS

CROSS REFERENCE TO RELATED APPLICATION

This application claims priority under 35 U.S.C. §119(e) to U.S. Provisional Application No. 60/754,642, filed on Dec. 30, 2005, the entire content of which is incorporated by reference.

BACKGROUND

Attempts have been made to add smoke modifiers, flavorants and/or flavor enhancers to smoking articles to provide a flavor or aroma or enhanced flavor or aroma to tobacco smoke. Previous methods have included coating or spraying fibrous elements of filters with flavorants. However, these techniques inevitably provide a surface coating which quickly evaporates or dissipates from the surface of the fibrous filter.

SUMMARY

Fibrous filters for smoking articles such as cigarettes are prepared by contacting fibers containing an additive to be impregnated therein with a gas at high pressure or a fluid at supercritical or near critical conditions and reducing the pressure such that the additive is impregnated within the internal matrix of the fiber. The high pressure gas or supercritical fluid (SCF) acts to swell the fibers thereby enabling the additive to impregnate the interstices of the fiber matrix. When the pressure is reduced, the gas or SCF is vaporized or dissipates leaving behind the impregnated and embedded additive which is slowly released from the fiber matrix over a period of time thereby delivering a more consistent and uniform flavor and aromatic characteristic.

In one specific embodiment, fibers from a material such as cellulose acetate are impregnated with a flavor-enhancing additive such as a dimethylpyrazine using a high pressure gas/supercritical fluid such as $CO_2$ to facilitate impregnation of the fibers. The impregnated fibers are then used to prepare filters for incorporation into cigarettes.

In another embodiment, a smoking article such as a cigarette is manufactured by forming a tobacco rod, placing a paper wrapper around the rod, providing a cigarette filter composed of high pressure impregnated fibers as discussed above, and attaching the filter to the tobacco rod to form the cigarette.

Another embodiment relates to a method of treating mainstream tobacco smoke by contacting the mainstream smoke with impregnated filters as previously described.

BRIEF DESCRIPTION OF DRAWING FIGURES

DETAILED DESCRIPTION

Figure 1:
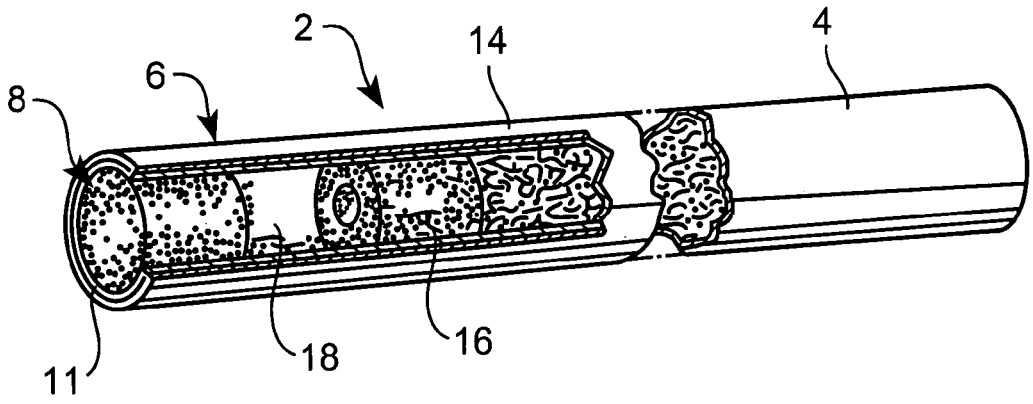
FIG. 1 is a perspective view of one embodiment where high pressure impregnated fibers are incorporated into a plug-space-plug filter element.

A method is provided whereby a fibrous element useful as a filter in a smoking article is prepared by impregnating fibers with an additive such as a flavorant, flavorant enhancer or scavenger using a gas at high pressures or a supercritical fluid (SCF) as a solvent or dispersant for the additive. The gas or SCF swells the fiber matrix and delivers the additive into the interstices of the fiber matrix. In some instances, the dissolved additive may also act to swell the fiber matrix. As the pressure is reduced, the gas or SCF dissipates from the fiber and the additive is deposited within the fiber matrix as the gas or SCF is removed. In the absence of heat or vacuum force, the impregnated fibers slowly release the additive over a finite and measurable period of time. Such slow release makes the impregnated fibers useful as flavor mediums in smoking articles since there is always a fraction of the additive within and on the fiber surface which can readily be removed or vaporized. The high pressure impregnation process provides fibers useful in cigarette filters which deliver the additive to tobacco smoke. Thus, more consistent and uniform flavor, taste and aroma characteristics are provided to the smoker.

Moreover, when the high pressure or supercritical conditions are removed, the gas or SCF simply evaporates or sublimes, thus leaving behind the impregnated fibers, which do not require additional purification steps.

For purpose of this document, the terms "fiber," "fiber element" and "fiber matrix" are intended to encompass monofilaments such as single strands elongated along one axis, bundles of monofilaments including combinations of monofilaments similar in length, as well as fabrics in the form of woven, braided, non-woven or spun structures or any other fibrous structure conventionally used in the construction of cigarette filters.

For purpose of this document, the term "additive" or "agent" refers to small-molecule, non-polymeric solids or liquids which are capable of dissolving in a supercritical fluid or high pressure gas and becoming impregnated within fiber matrices or interstices when the fibers are removed from supercritical conditions. If the "additive" or "agent" does not exhibit a high solubility in the supercritical fluid or high pressure gas, the additive or agent could be dissolved in a suitable liquid solvent and the resultant solution dissolved in the supercritical fluid or high pressure gas and delivered to the fiber. In this instance, the additive or agent preferentially impregnates the fiber matrices or interstices so that when the pressure is reduced, the supercritical fluid or high pressure gas and the liquid solvent are readily removed leaving behind the agent or additive.

Fibers, fiber webs and fibrous elements which may be impregnated in accordance with the embodiments described herein include those spontaneously wettable polyester fibers described in U.S. Pat. No. 5,356,704, incorporated entirely by reference herein. Also suitable are the multilobal fibers described in U.S. Pat. No. 6,584,979, and the semi-open, micro cavity-containing fibers disclosed in U.S. Pat. No. 6,772,768, both patents incorporated herein in their entirety.

The impregnation technique described herein may also be employed to treat fibrous cellulose acetate elements for use in cigarette filters as described in U.S. Pat. No. 4,281,671, the disclosure of which is also incorporated herein in its entirety.

As used herein, a supercritical fluid refers to a material maintained at or above its critical temperature ($T_c$) and critical pressure ($P_c$) (i.e. above its critical point ($C_p$)), so as to place the material in a supercritical fluid state. Typically, supercritical fluids are gases at ambient temperature (approximately 22° C.) and pressure (approximately 1.01 mega Pascals (MPa)). However, when maintained at or above $C_p$, the supercritical fluid displays properties of both a gas and a liquid. In particular, such a supercritical fluid has the solvent characteristics of a liquid, but the low surface tension of a gas. Accordingly, as with a gas, the supercritical fluid can more readily diffuse into a selected fibrous matrix.

"Near-critical fluid" includes conditions where the gas is either at or below the critical temperature or pressure wherein the properties of the gas are at a state where it begins to approach those of a supercritical fluid. Near-critical fluid can further be divided into subcategories "near-critical gas phase" and "near-critical liquid phase" depending on the state that the fluid is in. "Near-critical gas phase" exists at pressures either less than or equal to the critical pressure and less than the bubble point pressure with temperatures somewhat below to above the critical temperature (e.g., 0.9 $T_c$ and above.) "Near-critical liquid phase" is defined as the phase that exists at temperatures either less than or equal to the critical temperature and pressures.

"Liquefied gas" includes all gases that are at a temperature and/or pressure where they are in a liquid state, but can readily be changed to a gaseous state by altering the temperature or pressure.

Table 1 lists several nonlimiting examples of supercritical fluids, including their critical temperatures and pressures that are useful in practicing the impregnation.

TABLE 1

Critical temperatures ($T_c$) and critical pressures ($P_c$) of selected supercritical fluids.

| Supercritical Fluid | $T_c$ in ° C. | $P_c$ in MPa |
|---|---|---|
| carbon dioxide | 31.1 | 7.38 |
| nitrous oxide | 36.5 | 7.26 |
| Ethylene | 9.3 | 5.03 |
| Ethane | 32.3 | 4.88 |
| Chlorotrifluoromethane | 29.9 | 3.92 |

In addition to the supercritical fluids listed in Table 1, a large number of other materials are also useful in the impregnation method, including without limitation, nitrogen, propane, propylene, cyclohexane, n-butane, n-pentane, ethanol, toluene, diethyl ether, acetone, ammonia, water, methane, trichlorofluoromethane, and other halogenated alkanes and alkenes such as tetrafluoroethylene, perfluoromethane, tetrafluoromethane, trifluoromethane, and 1,1-difluoroethylene. The specific $T_c$ and $P_c$ for each of these materials, and for any other supercritical fluid useful in the embodiments disclosed herein are readily obtainable in a number of standard references, including the *CRC Handbook of Chemistry and Physics,* 67$^{th}$ ed., CRC Press Inc., Boca Raton, Fla., 1987, *Matheson Gas Data Book,* 6$^{th}$ ed., Matheson Co., Inc., Lyndhurst, N.J., 1980, *Merck Index,* 10$^{th}$ ed., Merck and Co., Rahway, N.J., 1983 and *Lange's Handbook of Chemistry,* 12$^{th}$ ed., McGraw Hill Book Co., New York, N.Y., 1979, the disclosures of which are herein incorporated by reference. Furthermore, it is also contemplated that mixtures of two or more supercritical fluids could also be used in the impregnation methods as described therein.

While any of a variety of supercritical fluids are useful in the methods of the embodiments described herein, it is preferred that the supercritical fluid be substantially nonreactive and inert with respect to the impregnation additives, carrier liquids, and fibers used. Co-solvents such as water can also be used.

Other factors that can influence the selection of a supercritical fluid for use in the impregnation methods include cost of the supercritical material, solubility of the supercritical material in the fiber to be impregnated, as well as the practical working limits of the $T_c$ and $P_c$ of the supercritical fluid. In this regard, it is preferred that the $T_c$ of the supercritical fluid be as close as possible to ambient conditions (e.g. approximately 22° C.), such that the supercritical fluid can be maintained at a temperature of from about 0° C. to about 100° C., preferably from about 20° C. to about 90° C., and most preferably from about 30° C. to about 80° C. These preferred temperature limits are advantageous with respect to some preferred additives which can be particularly susceptible to thermal degradation at temperatures in excess of about 80° C.

The preferred limits on the $P_c$ and the operating pressures of the supercritical fluid used can be selected based on commercial considerations. For example, the upper limits of the operating pressures can be selected based on cost and availability of equipment capable of containing pressures in excess of 138 MPa (20,000 psi), as well as the susceptibility of the impregnation additive and/or fiber to degradation at higher pressures. In this regard, it is preferred that the supercritical fluid be maintained at pressures from about 4 MPa to about 138 MPa, more preferably from about 5 MPa to about 45 MPa, and most preferably from about 7 MPa to about 30 MPa. Additives will preferably be subjected to the minimum critical pressures necessary to ensure impregnation.

With respect to the solubility of the supercritical fluid in the fibers to be impregnated, it is preferred that the selected supercritical fluid show minimal solubility in the fiber to be impregnated. Thus, the supercritical fluid should have sufficient solubility to swell the fiber matrix, and thereby allow for the penetration of the liquid and impregnation additive therein, but not provide such a degree of solubility that the fibrous matrix loses its form and/or dissolves substantially into the supercritical fluid.

Given the requirements outlined above, supercritical carbon dioxide provides a particularly preferred supercritical fluid for use in the described impregnation methods. Supercritical carbon dioxide is a low cost, inert, material displaying a $T_c$ of 31.1° C. and a $P_c$ of 7.38 MPa. Furthermore, supercritical carbon dioxide displays sufficient solubility to swell a wide variety of fibrous materials prepared from polymeric materials such as cellulose acetates, polyolefin such as polyethylenes and polypropylenes, polyethylene terephthalates and the like.

Suitable impregnation additives include flavorants, flavorant enhancers, free radical scavengers, antioxidants, etc. which are capable of being dissolved or dispersed in the high pressure gas or SCF, impregnated into the fiber matrix when the fluid is removed and that can readily be released from the fibers into tobacco smoke even after long term storage. Nonlimiting classes of additives include smoke-modifying agents which impart an additional taste or aroma to smoke passing through the filter and agents which scavenge free-radicals or otherwise may even suppress certain flavors or aromas. Additives which may be used in the disclosed fiber impregnation method include tobacco smoke modifying agents which typically modify the taste and/or aroma of smoking product. Thus, the tobacco smoke modifying agent can be a flavorant or other aromatic material including both naturally occurring and synthetic materials regardless of their hydrophobic or hydrophilic nature. Examples of such tobacco smoke modifying agents include flavorants, synergistic flavor enhancers, physiological coolants and other mouth or throat stimulants, with flavorants being preferred.

In some cases, it might be desirable to impregnate the filter fibers with additives that remain anchored in the fibers and are not released from the fiber matrix. Such additives might include substances that selectively remove certain constituents from tobacco smoke.

Typical examples of flavorants include natural and synthetic materials which augment the minty, camphoraceous, spicy, peppery, fruity, flowery, woody, green, or other tobacco flavor and aroma notes. Other flavorants contemplated for use include naturally occurring or synthetic flavorants such as citrus oils, tobacco extracts, wine, rum, honey, vanilla, molasses, maple syrup, chocolate, menthol, vanillin, licorice, anethole, anise, cocoa, cocoa and chocolate by-products, eugenol, clove oil, and other generally accepted flavorant filter additives.

Examples of synergistic flavor enhancers include glutamates and nucleotides, 2 cyclohexylcyclohexanone, pyrazines such as dimethylpyrazines, alkylpyridines, etc. Examples of naturally occurring physiological coolants include mint oils, menthol, camphor and camphoraceous compounds. Examples of synthetic physiological coolants include synthetic menthol and menthol derivatives, and synthetic camphor and camphoraceous compounds such as cyclohexenones and cyclohexanones.

Examples of free radical scavengers and antioxidants include glutathione, cysteine, N-acetylcysteine, ascorbates, N,N'-diphenyl-p-phenylenediamine, etc.

The disclosed high pressure gas or SCF fiber impregnation technique is preferably employed to produce fibrous elements impregnated with additives for use in preparing tobacco smoke filters preferably for cigarettes. The fibrous elements are quite useful for the efficient and uniform delivery of tobacco smoke modifying agents and for efficient and uniform selective removal of targeted substances such as free radicals. The direct economic value of the process results from cost savings achieved through reductions in the quantity of expensive agents, especially flavorants that are needed to achieve a desired organoleptic effect. Other benefits include increased shelf life, improved consistency of product taste which results from more constant delivery of the tobacco smoke modifying agent from puff to puff, and/or improved efficiency of selective removal of targeted substances.

To prepare the filter elements, the tobacco smoke modifying additive(s) or agent(s) is applied to fibers or an assemblage of fibers. Such assemblage can be, for example, a nonwoven web. The fibers may be made into a nonwoven web by conventional techniques well known in the art. After application of the tobacco smoke modifying agent(s) to the fibers, the combination is incorporated into the filter element of a smoking article. The impregnated fibers, web or filaments may be incorporated in various filter arrangements including the following filter constructions.

FIG. 1 illustrates one embodiment for incorporating the impregnated fibers into a cigarette filter. A cigarette 2 comprises a tobacco rod 4 and a filter portion 6 in the form of a plug-space-plug filter having a mouthpiece filter 8, a plug 16, and a space 18. The plug 16 can comprise a tube or cylinder of impregnated fiber material such as polypropylene or cellulose acetate fibers. The tobacco rod 4 and the filter portion 6 are joined together with tipping paper 14. The filter portion 6 may include a filter overwrap 11. The filter overwrap 11 may contain traditional fibrous filter material as well as additive-impregnated fibrous material as described above. Alternatively, the impregnated fibers can be incorporated in the mouthpiece filter 8, in the plug 16, and/or in the space 18. Moreover, the impregnated fibers can be incorporated in any element of the filter portion of a cigarette. For example, the filter portion may consist only of the mouthpiece filter 8 and the impregnated fibers can be incorporated in the mouthpiece filter 8.

Figure 2:
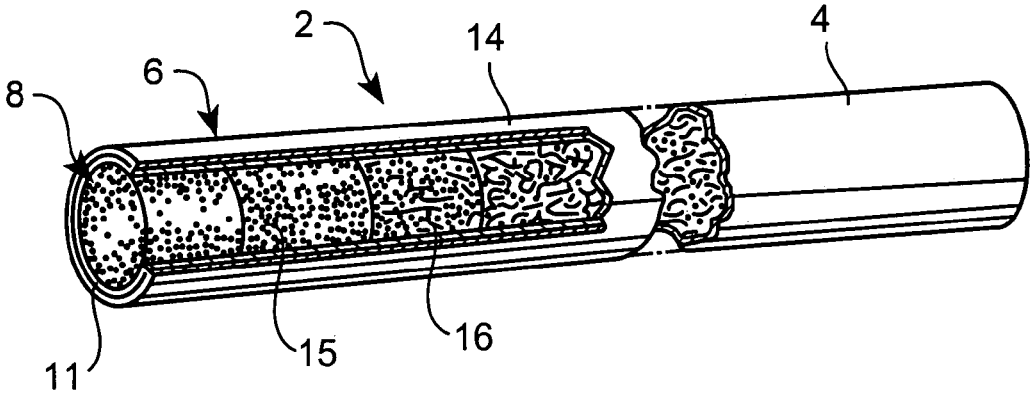
FIG. 2 is a perspective view of another embodiment where impregnated fibers are incorporated in a three-piece filter element having three plugs.

FIG. 2 shows a cigarette 2 comprised of a tobacco rod 4 and filter portion 6. This arrangement is similar to that of FIG. 1 except the space 18 is filled with a plug 15 made of fibrous polypropylene or cellulose acetate impregnated with a smoke-modifying agent as described above. As in the previous embodiment, the plug 16 can be a tube or cylinder and the tobacco rod 4 and filter portion 6 are joined together with tipping paper 14. There is also a filter overwrap 11.

Figure 3:
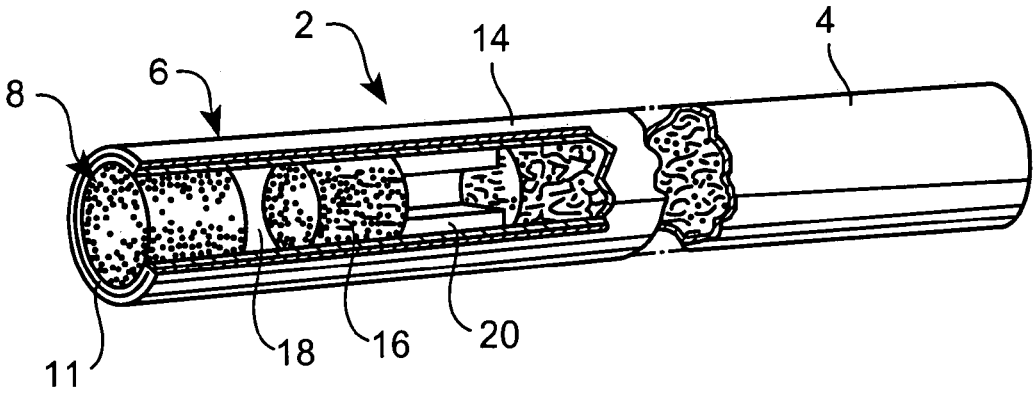
FIG. 3 is a perspective view of another embodiment where impregnated fibers are incorporated in a four-piece filter element having a plug-space-plug arrangement and a hollow sleeve.

FIG. 3 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. The impregnated fibers can be incorporated into one or more elements of the filter portion 6. For instance, the fibers can be incorporated into the sleeve 20 or the plug 16 and sleeve 20 can be made of material such as fibrous polypropylene or cellulose acetate impregnated with the additive. As in the previous embodiment, the plug 16 can be a tube or cylinder.

Figure 4:
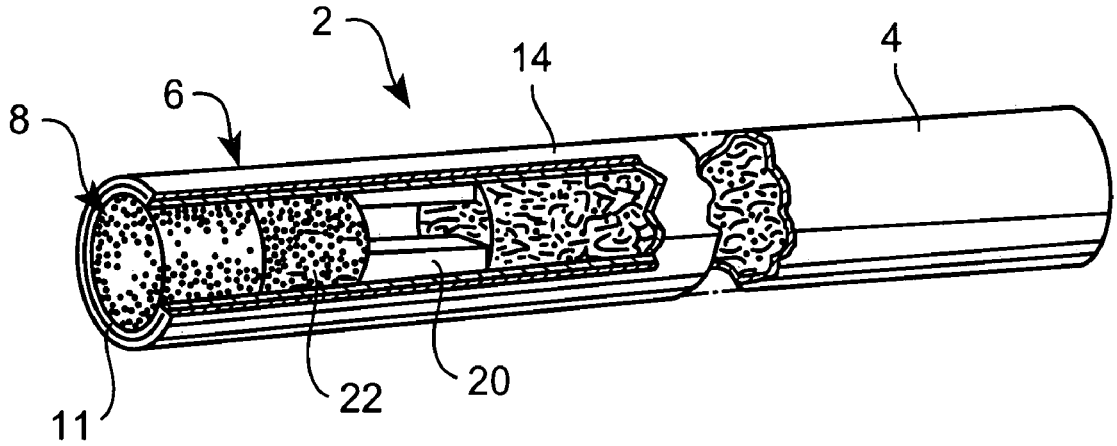
FIG. 4 is a perspective view of another embodiment where impregnated fibers are incorporated in a three-part filter element having two plugs and a hollow sleeve.
Figure 5:
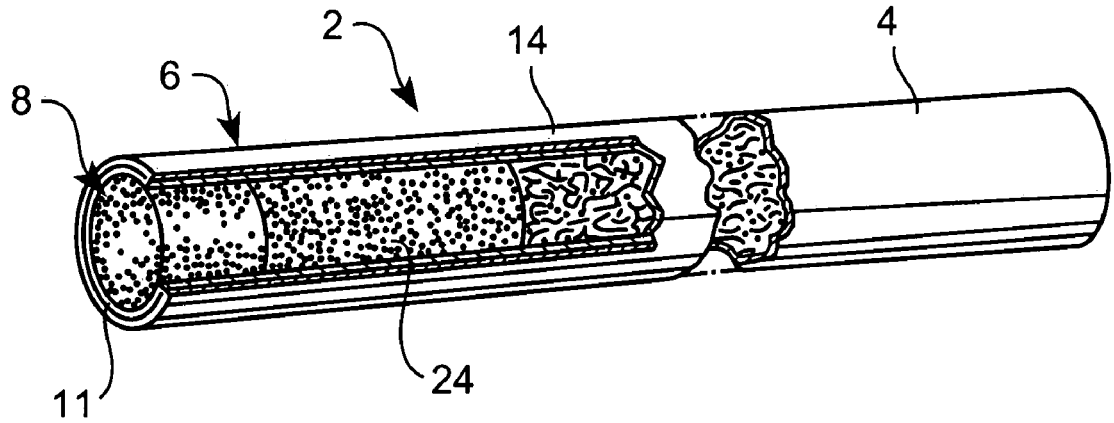
FIG. 5 is a perspective view of another embodiment where impregnated fibers are incorporated in a two-part filter element having two plugs.

FIGS. 4 and 5 show further modifications of the filter portion 6. In FIG. 4, cigarette 2 is comprised of a tobacco rod 4 and filter portion 6. The filter portion 6 includes a mouthpiece filter 8, a filter overwrap 11, a plug 22, and a sleeve 20, and the impregnated fibers can be incorporated in one or more of the filter elements. In FIG. 5, the filter portion 6 can include a mouthpiece filter 8 and a plug 24, and the impregnated fibers can be incorporated in one or more of these filter elements. Like the plug 16, the plugs 22 and 24 can be a tube or cylinder. In the cigarettes shown in FIGS. 4 and 5, the tobacco rod 4 and filter portion 6 are joined together by tipping paper 14.

Figure 6:
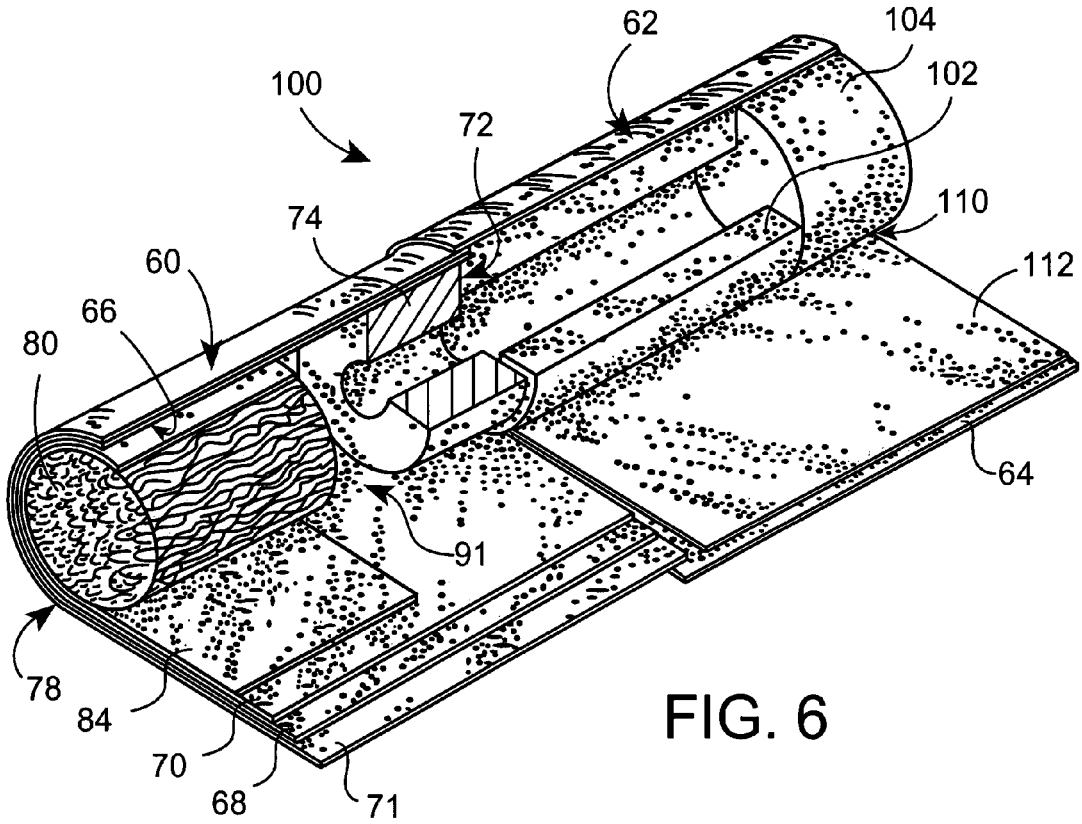
FIG. 6 is a perspective view of another embodiment where impregnated fibers are incorporated in a filter element which may be used in a different smoking article.

In another embodiment, impregnated fibers can be employed in a filter portion of a cigarette for use with a smoking system as described in U.S. Pat. No. 5,692,525, the entire content of which is hereby incorporated by reference. FIG. 6 illustrates one type of construction of a cigarette 100 which can be used with an electrical smoking system. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating the impregnated fibers.

In such a cigarette, the impregnated fibers also can be incorporated in various ways such as by being fitted into the passageway of the tubular free-flow filter element 102 therein. They may also be deployed as a liner or a plug in the interior of the tubular free-flow filter element 102. Alternatively, the impregnated fibers can be incorporated into the fibrous wall portions of the tubular free-flow filter element 102 itself. For instance, the tubular free-flow filter element or sleeve 102 can be made of suitable materials such as additive-impregnated polypropylene or cellulose acetate fibers.

In another embodiment, the impregnated fibers can be incorporated into the mouthpiece filter plug 104 instead of in the element 102. However, as in the previously described embodiments, the impregnated fibers may be incorporated into more than one component of a filter portion such as by being incorporated into the mouthpiece filter plug 104 and into the tubular free-flow filter element 102.

Another embodiment relates to a method of making a cigarette, said method comprising: (i) providing a cut filler to a cigarette making machine to form a tobacco rod; (ii) placing a paper wrapper around the tobacco rod; (iii) providing a cigarette filter comprising an impregnated fibrous element as described above; and (iv) attaching the cigarette filter to the tobacco rod to form the cigarette.

In another embodiment, a method is provided of treating mainstream tobacco smoke by passing the smoke through a filter containing impregnated fibers as described above, the method comprising drawing the smoke through the impregnated fibers, wherein taste and aroma characteristics are provided to the mainstream smoke or certain constituents are selectively removed from the smoke.

"Smoking" of a cigarette means the heating or combustion of the cigarette to form smoke, which can be drawn through a smoking article. Generally, smoking of a cigarette involves lighting one end of the cigarette and drawing the cigarette smoke through the mouth end of the cigarette, while the tobacco contained therein undergoes a combustion reaction. However, the cigarette smoke may be treated by other means. For example, the cigarette smoke may be treated by heating the cigarette and/or heating using electrical heater means, as described in commonly-assigned U.S. Pat. No. 6,053,176, for example.

Figure 7:
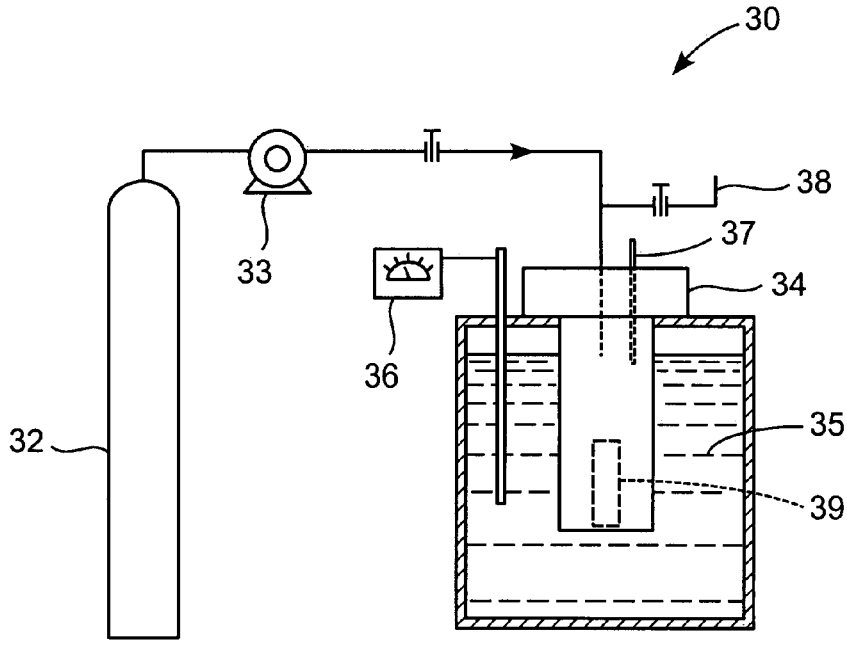
FIG. 7 is a schematic illustration of another embodiment showing an example of an impregnation apparatus for treating fibers with supercritical fluids.

FIG. 7 schematically illustrates an apparatus which can be employed to produce fibrous article impregnated with agents and additives as described above. Major components of the apparatus 30 include a holding tank 32 that holds the material to be used as a high pressure gas or SCF, a compressor 33 to pressurize and transfer the supercritical fluid or gas from the holding tank 32 to a pressure vessel 34, a water or oil or air bath 35 in which the pressure vessel 34 is suspended, a temperature regulator 36 to maintain the water/oil bath 35 at a predetermined temperature, a pressure transducer 37 to monitor and maintain the pressure within the pressure vessel 34 at a predetermined level, and a vent line 38, to be used to vent the high pressure gas or SCF from pressure vessel 34 after impregnation has been completed.

In use, a fiber sample to be impregnated is placed in a container such as a stainless steel mesh bag 39 within the pressure vessel 34. A measured amount of one or more additives is added to the pressure vessel 34. The pressure vessel is then sealed and placed in the water/oil bath. To initiate the impregnation procedure, a selected gas such as carbon dioxide, is transferred from tank 32 to compressor 33, where it is pressurized to the critical pressure (Pc) of the material, or greater. The compressed material leaves compressor 33 and is transferred into the pressure vessel containing the sample to be impregnated.

When the pressurized material enters pressure vessel, it may already comprise a supercritical fluid, so long as the temperature of the pressurized material exceeds the critical temperature ($T_c$) of the material. However, if the pressurized material has not yet reached or exceeded $T_c$, then water/oil bath 35 can be heated using temperature regulator 36 to convert the pressurized material into a supercritical fluid capable of swelling the polymer sample. In this regard, it will be appreciated that both temperature regulator 36 and pressure transducer 37 can be used to maintain the pressure vessel including the supercritical fluid, fibrous sample and impregnation additive contained therein, at a preselected temperature and pressure above the $T_c$ and PC of the supercritical fluid.

After sufficient time has passed to complete impregnation of an impregnation additive into the sample in container 39, the supercritical fluid contained in the pressure vessel is vented from the pressure vessel. In this regard, the pressure vessel should be vented in a controlled manner (e.g., at a slow regular rate) to prevent damage (e.g., fracturing and/or foaming) to the samples.

It will be appreciated that the pressure vessel may be vented directly to the atmosphere, or may be vented into a holding container (not shown), and re-circulated to tank 32 as desired. After the supercritical fluid has been vented, the pressure vessel can be opened, and the impregnated sample recovered from container 39.

While the impregnation of a sample with one or more impregnation additives has been illustrated with respect to FIG. 7, it will be appreciated that any apparatus capable of containing a supercritical fluid, sample, and impregnation additive(s), such that the sample is impregnated with the impregnation additive(s), is considered to fall within the scope of the present process. In this regard, those skilled in the art will be readily capable of adapting the apparatus illustrated such as through the incorporation of a thermocouple into the pressure vessel, thereby eliminating the need for the water/oil bath, or in any other manner consistent with the practice of the hereinbefore disclosed process.

EXAMPLE 1

The following experiments were performed using a Parr mixer. The experimental protocol was as follows:

1. Load ~0.5 to 1.0 g of cellulose acetate (CA) fibers into a stainless steel mesh bag. The bag was sealed with staples to reduce the loss of CA fibers during mixing.
2. The mesh bag was tied to the stirring shaft using a metal wire. For a few experiments, cellulose acetate fibers were directly tied to the stirring shaft without being put into a mesh bag.
3. Load 2 to 15 g of 2,5-dimethylpyrazine (DMP) into the vessel of the Parr mixer.
4. Connect the mixing head to the vessel.
5. Transfer $CO_2$ into the vessel cooled with a mixture of dry ice and acetone.
6. Assemble the mixer on the support stand, start stirring, and heat the vessel to the desired temperature. Maintain a constant system pressure by venting $CO_2$ if the pressure is higher than the target operating pressure.
7. Stir for ~30 minutes at constant temperature and pressure and then flush the vessel with nitrogen for ~10 minutes at the same operating pressure to remove excess DMP from the vessel. The flush step minimizes the amount of DMP that can possibly deposit onto the CA fiber when the pressure is decreased. Then vent the nitrogen from the vessel to reduce the pressure to atmospheric conditions. Open the vessel and recover the sample. $N_2$ flushing was not used in some of the experiments.

8. Weigh the sample in the mesh bag immediately after treatment.
9. Track the sample weight as a function of time.
10. After seven days recover the CA from the mesh bag and continue to track the CA sample weight over time.

All of the experiments were performed at 40° C. and 1,750 psig with approximately 80 g of $CO_2$ loaded into the mixer unless otherwise noted. The operating pressure was chosen to ensure that the DMP-$CO_2$ mixture was a single phase at 40° C. for all the concentrations tested.

Results

The CA fiber maintained a ~2 wt % increase even one month after treatment (see data in Table 2). The CA initial weight increase is linear with the amount of 2,5-dimethylpyrazine added to the mixer. The amount of DMP remaining in the CA fiber quickly reaches a maximum with respect to DMP loading in the mixer. The result from samples ZS110 and ZS111 suggest that it is not necessary to flush the cell with $N_2$ after fiber treatment since $N_2$ flushing was used in one of these samples but not in the other.

TABLE 2

Matrix of 2,5-dimethylpyrazine (DMP)-CA experiments. The CA weight increase was determined one month after fiber treatment.

| Sample # | CA loaded into mixer (g) | DMP loaded into mixer (g) | DMP/CA weight ratio | DMP in $CO_2$ (CA-free basis) (wt %) | CA weight increase (wt %) |
|---|---|---|---|---|---|
| ZS101 | 0.768 | 14.11 | 18.4 | 15.0 | 6 |
| ZS102 | 0.770 | 7.10 | 9.2 | 8.2 | 4 |
| ZS103 | 0.837 | 3.96 | 4.7 | 4.7 | 4 |
| ZS104 | 0.530 | 12.10 | 33.8 | 13.1 | 6 |
| ZS105 | 0.767 | 10.02 | 13.1 | 11.1 | 6 |
| ZS106 | 0.715 | 4.03 | 5.6 | 4.8 | 6 |
| ZS107 | 0.875 | 2.01 | 2.3 | 2.5 | 4 |
| ZS108 | 0.925 | 2.01 | 2.2 | 2.5 | 3 |
| ZS109 | 0.820 | 2.02 | 2.5 | 2.5 | 3 |
| ZS110 | 0.890 | 2.03 | 2.3 | 2.5 | 3 |
| ZS111 | 0.928 | 2.02 | 2.2 | 2.5 | 3 |

A part of the CA treated with more than 10 wt % DMP (CA-free basis) dissolved most of the fiber. In this instance, the DMP/CA fiber weight ratio was ~13. If less DMP is added to the impregnation vessel, the chances of dissolving the fiber are reduced considerably. CA samples maintained dimensional integrity if treated with less than 10 wt % DMP (CA-free basis). This particular experiment was run at a DMP/CA fiber weight ratio of ~2.5. These data suggest that DMP should be a good swelling agent for the CA fiber.

As a control, three CA samples were treated in pure $CO_2$ at 40° C. and 1,750 psig for 30 minutes and were flushed with $N_2$ at ~2,000 psig for ~10 minutes before venting the mixer. A ~2 wt % increase was observed in weight of sample ZS109 whereas a control sample actually loses ~2 wt % over the same period. The $CO_2$-treated CA fiber did not exhibit any obvious dimensional changes.

Table 3 lists the experimental conditions used to determine the impact of operating/contact temperature, water as a cosolvent/CA swelling agent, nitrogen flush, and mixing time on the uptake of 2,5 DMP into CA fiber. The main conclusions from these experiments were:

1) varying the operating temperature between 18 and 63° C. has no discernable effect on DMP uptake;
2) $CO_2$ humidified with water had no discernable effect on DMP uptake; the amount of water was kept close to, but less than, the equilibrium amount of water expected to dissolve in $CO_2$ at operating conditions used here;
3) flushing the vessel with nitrogen to remove excess DMP had no discernable effect on DMP uptake;
4) when varied between five and 30 minutes, mixing/contact time had very little effect on DMP uptake with or without deionized water.

TABLE 3

Matrix of 2,5-dimethylpyrazine (DMP)-CA experiments performed to determine the impact of mixing time, nitrogen flush, operating temperature, and distilled water cosolvent on the uptake of DMP into CA fiber. Approximately one gram of CA fiber was used for each experiment and the DMP/CA fiber weight ratio was fixed at 2.2 ± 0.4; the operating pressure was fixed at 1500 ± 60 psig; nitrogen was used at the end of the contact time to flush residual DMP from the vessel for only four experiments; a 30 minute mixing/contact time was used for the DMP-$CO_2$ mixture with CA fiber except in five cases; deionized water is used to determine whether it improved DMP impregnation. A dashed line means that the item was not added to the mixer.

| Sample # | DMP loaded into mixer (g) | Water loaded into mixer (g) | Water in $CO_2$ (wt %) (CA-free basis) | Operating Temperature (° C.) |
|---|---|---|---|---|
| FM01 | — | — | — | Room T |
| FM02 | — | — | — | Room T |
| FM03 | — | — | — | Room T |
| FM04 | — | — | — | Room T |
| FM05 | — | — | — | 21 |
| FM06 | — | — | — | 19 |
| FM07 | 2.04 | — | — | 20 |
| FM08 | 2.06 | — | — | 22 |
| FM09 | 2.00 | 0.4 | ~0.5 | 22 |
| FM10 | 1.94 | 0.4 | ~0.5 | 23 |
| FM11 | — | 0.4 | ~0.5 | 20 |
| FM12 | — | 0.4 | ~0.5 | 25 |
| FM13 | — | — | — | 60 |
| FM14 | — | — | — | 59 |
| FM15 | — | 0.4 | 0.92 | 59 |
| FM16 | — | 0.2 | 0.46 | 60 |
| FM17 | 1.71 | — | — | 60 |
| FM18 | 1.91 | — | — | 62 |
| FM19 | 1.49 | 0.2 | 0.46 | 62 |
| FM20 | 1.60 | 0.2 | 0.46 | 62 |
| FM21[a] | 1.76 | — | — | 18 |
| FM22[a] | 1.46 | — | — | 21 |
| FM23[b] | 2.72 | — | — | 18 |
| FM24[b] | 1.97 | — | — | 20 |
| FM25[b] | 2.01 | 0.4 | ~0.5 | 23 |

[a]five minutes mixing time;
[b]15 minutes mixing time.

The results of this Example show that cellulose acetate (CA) fiber can be impregnated with 2,5-dimethylpyrazine (DMP) using $CO_2$ at temperatures as low as room temperature and pressures near 1,500 to 1,700 psia. Even one month after treatment, the CA fiber still retains ~1 to 2 wt % 2,5 DMP (10,000 to 20,000 ppm). There is no discernable difference between virgin CA fiber and fiber treated with pure $CO_2$. Also, the fiber treated with pure $CO_2$ only does not exhibit a significant weight loss or weight gain. The initial weight increase of the CA fiber one month after treatment is directly proportional to the amount of 2,5 DMP used in the impregnation experiment up to a DMP/CA weight ratio of ~five.

EXAMPLE 2

$CO_2$ is used to impregnate CA fiber with solid vanillin (hereafter called VA) which melts at ~82° C. and solid menthol (hereafter called MEN) which melts at ~45° C. The procedures used for impregnating CA fiber with VA and MEN are similar to those in the previous example for pyrazine. The initial results for impregnation of VA into fibers are listed in Table 4. The main conclusions to be drawn from the data are:

1. it is possible to impregnate fibers with solid VA;
2. at a pressure of 750 psig the solubility of vanillin in $CO_2$ is so low that, with the exception of sample KV11, virtually no vanillin is transferred to the CA fiber; and 3. at an intermediate pressure of 1,500 psig CA fiber imbibes ~10 wt % vanillin. This level of vanillin loading drops if the pressure is increased to 2,500 psig. The solvent power of $CO_2$ is too high at 2,500 psig so that vanillin preferentially partitions in the $CO_2$-rich phase rather than in the fiber.

TABLE 4

Initial vanillin impregnation experiments with CA fiber. The fiber/vanillin ratio is fixed at five for these initial experiments. The Gain is the wt % increase in fiber weight.

| Sample # | 20° C. | 50° C. | 750 (psig) | 1500 (psig) | 2500 (psig) | Gain (wt %) |
|---|---|---|---|---|---|---|
| KV01A1 | x | | | x | | 5.5 |
| KV02A1 | x | | | x | | 6.7 |
| KV03A1 | x | | | x | | 5.3 |
| KV041A3 | x | | | | x | 4.3 |
| KV05A3 | x | | | | x | 4.2 |
| KV06C1 | | X | | x | | 11.9 |
| KV07C1 | | X | | x | | 11.6 |
| KV08C1 | | X | | x | | 10.2 |
| KV09C3 | | X | | | x | 4.6 |
| KV10C3 | | X | | | x | 5.0 |
| KV12 | x | | x | | | 0.3 |
| KV13 | | X | x | | | −0.3 |
| KV14 | | x | x | | | −0.1 |
| KV15 | | x | x | | | −0.5 |
| KV16 | x | | x | | | 0.4 |

The experiments listed in Table 5 below were performed to determine if fluffing the CA fiber before impregnation had any effect on the amount of vanillin transferred to the fiber. It does not. These data again suggest that a lower pressure of 1,500 psig is preferred to 2,500 psig for optimum fiber loading, and a temperature of 50° C. appears to increase the amount of vanillin transferred compared to that transferred at 20° C. This is not surprising since the sublimation pressure of vanillin will be higher at 50° C., which helps to increase the solubility of vanillin in $CO_2$, especially if the pressure is high where the $CO_2$ density is increased.

TABLE 5

Initial vanillin impregnation experiments with CA fiber that has been stretched so that it resembles cotton. The fiber/vanillin ratio is fixed at five for these initial experiments. The Gain is the wt % increase in fiber weight.

| Sample # | 20° C. | 50° C. | 1500 (psig) | 2000 (psig) | 2500 (psig) | Gain (wt %) |
|---|---|---|---|---|---|---|
| CV01A3 | x | | | | x | 5.5 |
| CV02A3 | x | | | | x | 2.7 |
| CV03A1 | x | | x | | | 6.6 |
| CV04A2 | x | | | x | | 6.8 |
| CV05A3 | x | | | | x | 7.2 |
| CV06A1 | x | | x | | | 7.5 |
| CV07C1 | | x | x | | | 8.4 |
| CV08C1 | | x | x | | | 13.8 |
| CV09C3 | | x | | | x | 6.2 |
| CV10C3 | | x | | | x | 7.2 |
| CV11A3 | x | | | | x | 5.4 |
| CV12C1 | | x | x | | | 8.3 |

Tables 6, 7, 8 and 9 list the conditions and results for impregnation experiments with vanillin and menthol where the experimental technique was more refined. The level of additive impregnation is expected to depend on the CA/additive ratio and the operating temperature and pressure, which affects the concentration of additive in $CO_2$ (on a fiber-free basis). The impact of these operating variables on additive impregnation varied slightly for the vanillin and menthol experiments. The optimum operating conditions for vanillin impregnation were 40° C. and 1,250 psig where typically the fiber weight increase was ~12%. The CA fiber weight increase was either ~2 to 5% or almost no gain at all for temperatures and pressures greater than, and less than, the optimum conditions. The increase in fiber weight was not a strong function of the CA/vanillin ratio. A CA/VA ratio of 5/1, at 40° C. and 1,250 psig, resulted in a fiber weight increase of ~12%.

TABLE 6

CA fiber impregnated with vanillin (VA). The Gain is the wt % increase in fiber weight.

| | Temperature (° C.) | | | | Pressure (psig) | | | | Fiber/VA (g/g) | | |
|---|---|---|---|---|---|---|---|---|---|---|---|
| Sample | 20 | 30 | 40 | 50 | 1000 | 1250 | 1500 | 2000 | 0.25 | 5 | Gain wt %) |
| VA01 | x | | | | | | x | | | x | 7.2 |
| VA02 | | x | | | | | x | | | x | 12.0 |
| VA03 | | x | | | x | | | | | x | 9.4 |
| VA05 | | x | | | | | x | | | x | 6.6 |
| VA06 | | x | | | | | x | | | x | 7.1 |
| VA07 | | x | | | | | | x | | x | 4.7 |
| VA08 | | x | | | | | | x | | x | 5.1 |
| VA09 | | x | | | | x | | | | x | 8.0 |
| VA10 | | x | | | | x | | | | x | 6.5 |
| VA11 | | | x | | x | | | | | x | 1.6 |
| VA12 | | | x | | x | | | | | x | 2.3 |
| VA13 | | | x | | | x | | | | x | 14.9 |
| VA14 | | | x | | | x | | | | x | 9.4 |
| VA15 | | | x | | | | x | | | x | 5.8 |
| VA16 | | | x | | | | x | | | x | 6.3 |
| VA17 | | x | | | x | | | | x | | 1.9 |
| VA18 | | | x | | | x | | | x | | 8.7 |
| VA19 | | | x | | | x | | | x | | 17.5 |
| VA20 | | | x | | | x | | | | x | 14.5 |
| VA21 | | | | x | x | | | | | x | 0.7 |
| VA22 | | | | x | x | | | | | x | 3.4 |
| VA23 | | | | x | | x | | | | x | 9.1 |
| VA24 | | | | x | | x | | | | x | 8.6 |

Similar trends in the impregnation data were observed for menthol. The optimum operating conditions were 40° C. and 1,000 psig for fiber impregnation of ~6 wt %. The amount of menthol imbibed by the fiber decreased to ~2 to 4% when either the temperature or pressure was increased or decreased from the optimum conditions. A CA/menthol ratio of two gave the best impregnation results. The lower optimum operating pressure and loading for menthol compared to vanillin is likely due to the higher $CO_2$ solubility of menthol compared to vanillin which means that menthol is less likely to partition to the fiber at operating conditions.

TABLE 7

Kinked CA fiber impregnated with menthol (MEN). The Gain is the wt % increase in fiber weight.

| Sample | 30° C. | 40° C. | 750 psig | 1000 psig | 1250 psig | 2500 psig | fiber/MEN of 2 | fiber/MEN of 5 | Gain wt %) |
|---|---|---|---|---|---|---|---|---|---|
| MEN01 | | x | | | x | | | x | 2.9 |
| MEN02 | | x | | | x | | | x | 2.9 |
| MEN03 | | x | | | x | | | x | 2.5 |
| MEN04 | | x | | x | | | | x | 5.4 |
| MEN05 | | x | | x | | | | x | 4.7 |
| MEN06 | | x | x | | | | | x | 2.6 |
| MEN07 | | x | x | | | | | x | 3.2 |
| MEN08 | x | | | x | | | | x | 3.6 |
| MEN09 | x | | | x | | | | x | 3.3 |
| MEN10 | x | | | | x | | | x | 1.1 |
| MEN11 | x | | | | x | | | x | 1.0 |
| MEN12 | | | | | | x | | x | 0.5 |
| MEN13 | x | | | | | x | | x | 0.1 |
| MEN17 | x | | | | x | | x | | 5.3 |
| MEN18 | x | | | | x | | x | | 4.9 |
| MEN19 | x | | | x | | | x | | 17.0 |
| MEN20 | x | | | x | | | x | | 20.8 |
| MEN21 | | x | | | x | | x | | 16.3 |
| MEN22 | | x | | | x | | x | | 7.8 |
| MEN23 | | x | | x | | | x | | 8.1 |
| MEN24 | | x | | x | | | x | | 21.2 |

Impregnation experiments were performed with preformed filters as shown in Tables 8 and 9. Essentially the same trends in fiber loading were observed with the filters as compared to loose CA fiber. The treated, preformed filters did not exhibit any significant dimensional changes relative to virgin filters.

TABLE 8

CA filters impregnated with vanillin (VA) and with a fiber/VA ratio of five. The Gain is the wt % increase in fiber weight.

| Sample | 30° C. | 40° C. | 1000 psig | 1250 psig | 1500 psig | Gain (wt %) |
|---|---|---|---|---|---|---|
| FILVA01 | | x | | x | | 12.2 |
| FILVA02 | x | | x | | | 20.7 |
| FILVA03 | x | | x | | | 17.5 |
| FILVA04 | x | | | x | | 12.0 |
| FILVA05 | x | | | x | | 13.0 |
| FILVA06 | x | | | | x | 11.2 |

TABLE 9

CA filters impregnated with menthol (MEN) using a fiber/VA ratio of five at 40° C. and 1,000 psig.

| Sample | Gain (wt %) |
|---|---|
| FILM01 | 8.9 |
| FILM02 | 12.0 |
| FILM03 | 11.4 |

The next experiments demonstrate the embodiment wherein the additive is first dissolved in a solvent and the SCF-impregnation process performed using the resultant additive+solvent solution to deposit preferentially the additive into the fiber. In this manner it is possible to process additives that, by themselves, only exhibit a very low solubility in the pure SCF solvent. For sample VAE01, 0.60 grams of solid vanillin were dissolved in 1.21 grams of ethanol. The ratio of CA fiber/vanillin was ~5.0. For sample VAE02, 0.61 grams of solid vanillin were dissolved in 1.22 grams of ethanol. The ratio of CA fiber/vanillin is again ~5.0. For EtOH Ref 1, 1.23 grams of pure ethanol were used but in this case no vanillin was added to the solution. The two vanillin-ethanol solutions and the pure ethanol were processed with CA fiber in the same manner as was described previously for pure solid vanillin or pure solid menthol or liquid pyrazine. Table 10 shows the conditions used to process these three solutions. Note that the fiber treated with pure ethanol had a weight increase of only 2.6 wt %. However, when vanillin is added to the ethanol and then that solution is used to treat the fibers, the fiber weight increased by 12 to 13 wt %. The difference in weight pick up by the fibers is due to the weight of vanillin impregnated into the fiber.

TABLE 10

CA filters impregnated with vanillin (VA) from a vanillin-ethanol solution and with a fiber/VA ratio of five. The Gain is the wt % increase in fiber weight.

| Sample | 40° C. | 50° C. | 1250 psig | 2000 psig | Gain (wt %) |
|---|---|---|---|---|---|
| VAE01 | x | | x | | 12.4 |
| VAE02 | | x | | x | 13.7 |
| EtOH Ref 1 | x | | x | | 2.6 |

While the disclosed embodiments has been described with reference to preferred embodiments, it is to be understood that variations and modifications may be resorted to as will be apparent to those skilled in the art. Such variations and modifications are to be considered within the purview and scope of the appended claims.

What is claimed is:

1. A process for preparing a tobacco smoke filter element which comprises:

(a) providing an admixture of a polymeric filament or polymeric fibrous mass and an additive selected from the group consisting of flavorants, flavorant enhancers, and combinations thereof in a vessel;

(b) adjusting the temperature and pressure conditions in the vessel to provide liquefied gas or supercritical fluid or near critical fluid conditions;

(c) introducing at least one gas into the vessel to produce a liquefied gas or supercritical fluid or near critical fluid, whereby said additive dissolves or disperses in said fluid or liquefied gas;

(d) maintaining temperature and pressure conditions in said vessel for a period of time sufficient to swell said polymeric filament or polymeric fibrous mass and allow the additive to impregnate an inner matrix of the polymeric filament or polymeric fibrous mass;

(e) diminishing pressure conditions in the vessel such that the liquefied gas or SCF or near critical fluid dissipates from the polymeric filament or polymeric fibrous mass; and (f) removing the impregnated polymeric filament or polymeric fibrous mass from the vessel, wherein the polymeric filament or polymeric fibrous mass are prepared from a polymer selected from the group consisting of cellulose esters and polyolefins, and said impregnated additive of said smoke filter element is capable of being imparted to mainstream tobacco smoke during smoking.

2. A method of making a filter for a smoking article which comprises:

(a) providing an admixture of a polymeric filament or polymeric fibrous mass and an additive selected from the group consisting of flavorants, flavorant enhancers, and combinations thereof in a vessel;

(b) adjusting the temperature and pressure conditions in the vessel to provide liquefied gas or supercritical fluid or near critical fluid conditions;

(c) introducing at least one gas into the vessel to produce a liquefied gas or supercritical fluid or near critical fluid, whereby said additive dissolves or disperses in said fluid or liquefied gas;

(d) maintaining temperature and pressure conditions in said vessel for a period of time sufficient to swell said polymeric filament or polymeric fibrous mass and allow the additive to impregnate an inner matrix of the polymeric filament or polymeric fibrous mass;

(e) diminishing pressure conditions in the vessel such that the liquefied gas or SCF or near critical fluid dissipates from the polymeric filament or polymeric fibrous mass;

(f) removing the impregnated polymeric filament or polymeric fibrous mass from the vessel;

(g) forming an impregnated filter element; and (h) incorporating the impregnated filter element into a filter of a smoking article, wherein the polymeric filament or polymeric fibrous mass are prepared from a polymer selected from the group consisting of cellulose esters and polyolefins, wherein the additive comprises menthol and the polymeric impregnated filament or polymeric fibrous mass contains up to 21.2 weight % of the menthol, and wherein said additive present in the impregnated filter element is capable of being imparted to mainstream tobacco smoke during smoking.

* * * * *